US007955190B2

(12) United States Patent
Werner et al.

(10) Patent No.: US 7,955,190 B2
(45) **Date of Patent: *Jun. 7, 2011**

(54) RELATIVE POSITION BETWEEN CENTER OF GRAVITY AND HIT CENTER IN A GOLF CLUB

(75) Inventors: Frank D. Werner, Teton Village, WY (US); Richard C. Greig, Jackson, WY (US)

(73) Assignee: Origin Inc., Jackson, WY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/630,419

(22) Filed: Dec. 3, 2009

(65) Prior Publication Data

US 2010/0137071 A1 Jun. 3, 2010

Related U.S. Application Data

(63) Continuation-in-part of application No. 12/131,501, filed on Jun. 2, 2008, now Pat. No. 7,846,042.

(51) Int. Cl.
*A63B 53/04* (2006.01)

(52) U.S. Cl. ..... 473/349

(58) Field of Classification Search ..... 473/314, 473/349, 290–291

See application file for complete search history.

(56) References Cited

U.S. PATENT DOCUMENTS

| | | | |
|---|---|---|---|
| 4,280,700 | A | 7/1981 | Plagenhoef |
| 4,322,083 | A | 3/1982 | Imai |
| 5,094,457 | A | 3/1992 | Kinoshita |
| 5,295,686 | A | 3/1994 | Lundberg |
| 5,333,862 | A | 8/1994 | Teramoto et al. |
| 5,375,840 | A | 12/1994 | Hirsch et al. |
| 5,772,526 | A | 6/1998 | Hano |
| 5,851,160 | A | 12/1998 | Rugge et al. |
| 5,935,020 | A | 8/1999 | Stites et al. |
| 6,190,267 | B1 | 2/2001 | Marlowe et al. |
| 6,599,202 | B2 | 7/2003 | Miyamoto |
| 7,070,512 | B2 | 7/2006 | Nishio |
| 7,077,762 | B2 | 7/2006 | Kouno et al. |
| 7,559,852 | B2 | 7/2009 | Werner et al. |
| 2001/0009873 | A1 | 7/2001 | Hasebe et al. |
| 2002/0094880 | A1 | 7/2002 | McCabe |
| 2002/0098900 | A1 | 7/2002 | Ford |
| 2007/0117648 | A1 | 5/2007 | Yokota |
| 2007/0117649 | A1 | 5/2007 | Williams et al. |

(Continued)

FOREIGN PATENT DOCUMENTS

| | | |
|---|---|---|
| JP | 2002035178 | 2/2002 |

OTHER PUBLICATIONS

Goodman, Lawrence E., Warner, William H., "Dynamics of Particle Systems and Plane Rigid Bodies", Dynamics, 1961, Wadsworth Publishing Company, Inc., Belmont, California.

(Continued)

*Primary Examiner* — Stephen L. Blau

(74) *Attorney, Agent, or Firm* — Theodore M. Magee; Westman, Champlin & Kelly, P.A.

(57) ABSTRACT

A golf club head is provided with a center of gravity positioned within a partial ellipsoid defined in an impact reference frame that has its origin at the hit center of the face of the golf club head. The majority of the partial ellipsoid is located toward the golfer from the hit center and all of the partial ellipsoid is below the hit center in the impact reference frame.

18 Claims, 9 Drawing Sheets

U.S. PATENT DOCUMENTS

| | | | |
|---|---|---|---|
| 2009/0181789 | A1 | 7/2009 | Reed et al. |
| 2009/0298614 | A1 | 12/2009 | Werner et al. |

OTHER PUBLICATIONS

Johnson, S. H., "Experimental Determination of Inertial Ellipsoids" and "Video Monitoring System to Measure Initial Launch Characteristics of Golf Ball." Science and Golf II: Proceedings of the World Scientific Congress on Golf, 1994, pp. 290-295 and 327-333, E & FN Spon, London.

Jorgenson, Theodore P., "The Physics of Golf", Second Ed., 1999, pp. 150-158, Springer-Verlag New York Inc. New York.

Korn, Granino A., Korn, Theresa M., "Vectors, Transformations, and Matrices" and Euler Angles. Mathematical Handbook for Scientists and Engineers: Definitions, Theorems, and Formulas for Reference and Review, 1961, pp. 76 and 412-413, McGraw-Hill Book Company, Inc. New York.

Maltby, R., "Golf Club Design, Fitting, Alteration & Repair." Ralph D. Maltby Enterprises, Inc., 1982, pp. 302-304.

Stachura, Mike, "Where's Your Hot Spot." Golf Digest, 2003, pp. 169-172.

Thomas, Frank W., "Iron Byron" Sets Distance Standards. United States Golf Association, Mar./Apr. 1978, http://turf.lib.msu.edu/1970s/1978/780305.pdf.

United States Golf Association. Procedure for Measuring the Flexibility of a Golf Clubhead. 1-8 Mar. 25, 2005.

United States Golf Association. Second Report on the Study of Spin Generation. "Determination of the Aerodynamic Behavior of Golf Balls for Iron Trajectories." Aug. 25, 2006.

United States Golf Association. Technical Description of the Pendulum Test. 1-12. Nov. 2003.

United States Golf Association. The Rules of Golf. "Appendix II Design of Clubs." 115. 2006-2007 edition.

Werner, Frank D., Greig, Richard C., How Golf Clubs Really Work and How to Optimize Their Designs, 2000, pp. 8 and 176-177, Origin Inc.

Prosecution Documents Associated with U.S. Appl. No. 12/131,501 including: Amendment filed Jul. 7, 2009, Office Action mailed Apr. 8, 2009, Response filed Feb. 26, 2009, Office Action mailed Jan. 28, 2009.

Prosecution Documents Associated with U.S. Appl. No. 12/131,501 including: Office Action mailed on Feb. 4, 2010.

Prosecution Documents Associated with U.S. Appl. No. 12/131,504 including: Office Action mailed May 28, 2010.

RELATIVE POSITION BETWEEN CENTER OF GRAVITY AND HIT CENTER IN A GOLF CLUB

REFERENCE TO RELATED CASES

This application is a continuation-in-part of and claims priority from U.S. patent application Ser. No. 12/131,501 filed on Jun. 2, 2008 and titled RELATIVE POSITION BETWEEN CENTER OF GRAVITY AND HIT CENTER IN A GOLF CLUB.

BACKGROUND

A golf club consists of a club head, a shaft extending out of the club head, and a grip or handle that is held by a player while swinging the golf club. There are numerous parameters in the design of a golf club that affect how far a golf ball can be hit with the club. Some of these include the weight of the club head, the loft angle of the club head, the face angle of the club head, the lie angle of the shaft, the position of the center of gravity within the club head, the spring effect of the club head, the length of the shaft, and many others.

Selecting parameter values for a golf club is usually done in a coordinate frame of reference known as a design reference frame, also called design frame. This frame of reference provides a set of orthogonal axes in which the size, position and angle of various structural elements of the club are defined by a designer. The design reference frame is defined relative to structural elements of the golf club and without reference to the swinging of the golf club such that the orientation of the golf club is static relative to the design frame, even while the golf club is being swung.

One problem with designing club heads within the design frame is that changes in the orientation of the club head caused by swinging the club are not reflected in the design frame. In particular, as the player grips and swings the club, the club head's orientation is rotated along each of three orthogonal axes. However, since the design frame is "anchored" to the golf club head, these changes in orientation will not be reflected in the coordinates of the design frame. For example, the position of the center of gravity and the position of the center of the club face are constant in the design frame even as the club moves during the swing. As a result, it is not possible to model the relative position and orientation of elements of the club head in relation to the golf swing using only the design frame.

The discussion above is merely provided for general background information and is not intended to be used as an aid in determining the scope of the claimed subject matter.

SUMMARY

A golf club head is provided with a center of gravity positioned within a partial ellipsoid defined in an impact reference frame that has its origin at the hit center of the face of the golf club head. The majority of the partial ellipsoid is located toward the golfer from the hit center and all of the partial ellipsoid is below the hit center in the impact reference frame.

This Summary is provided to introduce a selection of concepts in a simplified form that is further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the Background.

DETAILED DESCRIPTION

Figure 1:
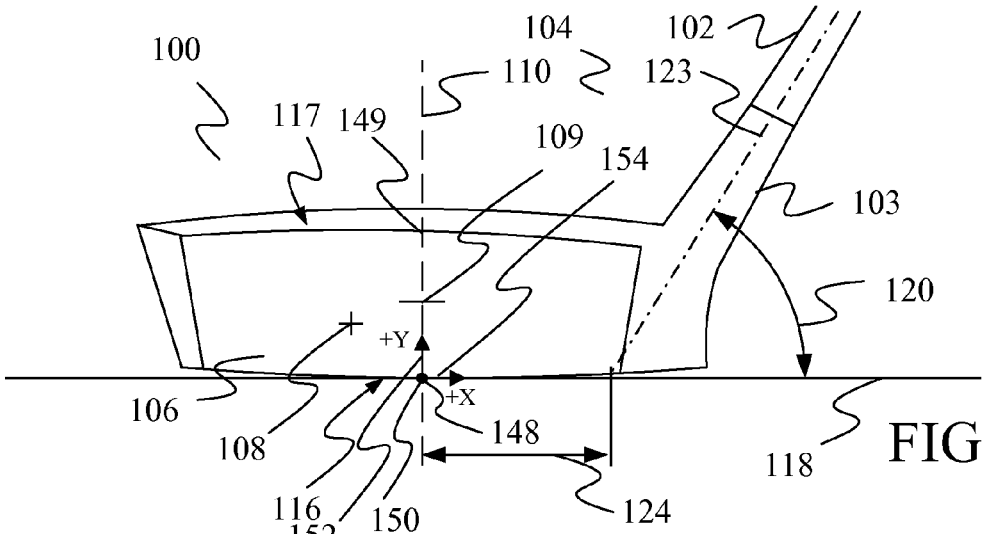
FIG. 1 is a front view of a golf club head and shaft under one embodiment.
Figure 2:
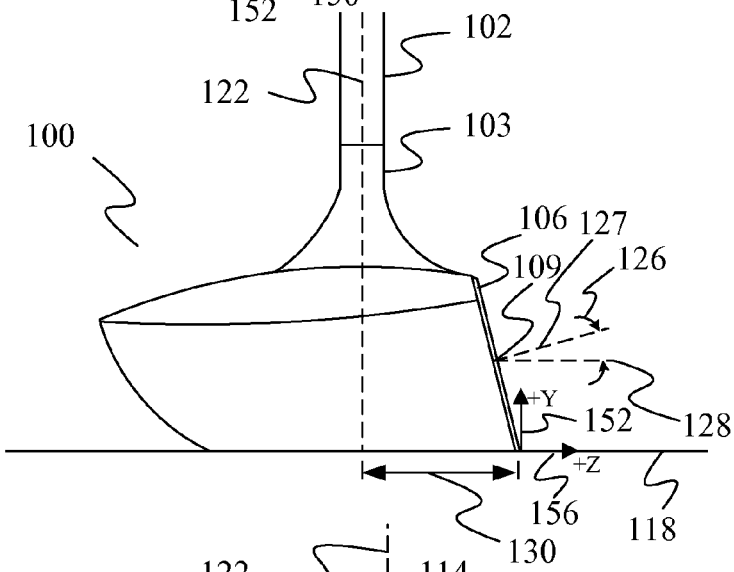
FIG. 2 is a side view of the golf club head and shaft of FIG. 1.
Figure 3:
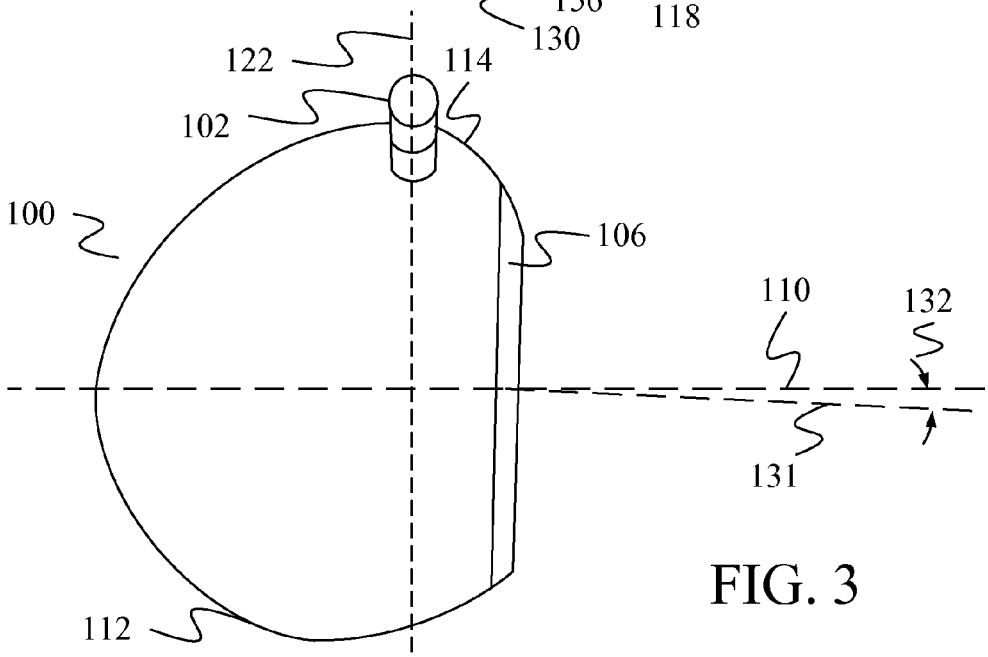
FIG. 3 is a top view of the golf club head and shaft of FIG. 1.

FIGS. 1, 2, and 3 provide a front, side and top view, respectively, of a golf club head 100 that receives a shaft 102 in a hosel 103 to form a golf club 104. Elements of the golf club head 100 are described with reference to three orthogonal planes: a shaft plane 122, a sole plane 118, and a face center plane 110. Golf club head 100 includes a face 106 having a hit center 108 and a face center 109, which is shown positioned along face center plane 110. Face center 109, defined below, is to be distinguished from hit center 108, which is a location on the club face where a designer expects the ball to contact the club face. Unlike the face center 109, which is always positioned along face center plane 110, hit center 108 may be positioned along face 106 toward a toe 112 from face center plane 110 or toward a heel 114 from face center plane 110 and may be positioned upward toward a crown 117 or downward toward a curved sole 116. Although face 106 is shown as flat in FIGS. 1, 2 and 3, those skilled in the art will recognize that face 106 normally is curved with "bulge" and "roll", or other non-flat characteristics.

In general, a hit center is indicated or implied by one or more marks on the face. In many instances, markings or the edges of markings denote a shape on the face. The point (not necessarily marked on the face) within this shape that is at the intersection of a horizontal line (not necessarily marked on the face) that bisects the shape and a vertical line (not necessarily marked on the face) that bisects the shape is then taken as the hit center on the face. For example, four pit marks on a face can define a diamond shape such that the hit center is implied to be at center of the diamond shape. Alternatively, the ends of a set of grooves can define a trapezoid with the hit center found vertically midway between the top groove and bottom groove of the set of grooves and found horizontally midway between the ends of two grooves that define part of the trapezoid and are horizontally aligned. In another example, the hit center can be located at the center of an elliptical marking or at the center of an elliptical shape formed by the ends of grooves or a collection of pit marks. Whether implied or marked explicitly, the hit center is indicated by markings on the face if someone viewing the markings on the face of the club is led to believe that there is a point on the club face that the designer of the club prefers over all other points on the club for contacting the ball. In the absence of such markings, the hit center is taken as being at the face center. Thus, the hit center is one of a set of possible hit centers consisting of a hit center indicated by markings on the face as being a point preferred over all other points on the club for contacting the ball and a hit center that is the same as a face center of the face.

Golf club 104 is oriented in two orthogonal planes: shaft plane 122 and sole plane 118. The club is positioned so that shaft centerline 123 of shaft 102 lies in shaft plane 122. Shaft centerline 123 forms a lie angle 120 with its orthogonal projection in sole plane 118. Face center plane 110 is orthogonal to both shaft plane 122 and sole plane 118. Face center plane 110 is located so the point of its intersection with both shaft plane 122 and sole plane 118 is a shaft progression distance 124 from the intersection of shaft centerline 123 and sole plane 118.

Under one embodiment, an iterative process is used to identify the face center. First, a rotational position of club 104 about shaft centerline 123 is selected and then club 104 is translated along shaft centerline 123 until sole 116 is tangent to sole plane 118. With this orientation, a line representing the normal projection of the intersection of face 106 and face center plane 110 into shaft plane 122 has an upper limit point 149 at the top of face 106 and a lower limit point 148 at the bottom of face 106. The mean point of this line projected normal to the shaft plane onto face 106 is the face center for this particular rotation position about shaft centerline 123. Note that in FIG. 1, lower limit point 148 is identical to sole point 150, which is along the intersection of sole plane 118 and face center plane 110. However, those skilled in the art will recognize that lower limit point 148 may be above sole plane 118.

Orthogonal projection 131 (FIG. 3), which is the outward normal to face 106 at the face center projected onto sole plane 118, forms a face angle 132 with face center plane 110. In FIGS. 2 and 3, a negative face angle is shown. When orthogonal projection 131 is on the other side of face center plane 110, the face angle is said to be positive. If face angle 132 differs from a stated design face angle, the rotational position of the club about the shaft axis is adjusted and the process of determining the face center is repeated until there is agreement between the measured face angle and the design face angle. When there is agreement, face center 109 has been discovered.

Under an alternative embodiment, face center 109 is taken to be along a midpoint line between a top edge of the face and a bottom edge of the face, where each point along the midpoint line marks the midpoint of a horizontal line from one side of the face to the other side of the face. Note that for some faces, the midpoint line will not be straight but instead will curve. The point along this midpoint line that is vertically midway between the top edge of the face and the bottom edge of the face is face center 109. In this context, a horizontal line is a line that is parallel to sole plane 118 when lie angle 120 between shaft center 123 and sole plane 118 matches a designed lie angle for the club and the club is rotated generally as shown in FIGS. 1-3.

Normal 127 to face 106 at face center 109 forms a loft angle 126 with a plane 128 that is parallel to plane 118 and intersects face center 109. Note that in FIG. 2, normal 127 points slightly out of the page as shown in FIG. 3 by the orthogonal projection 131 of normal 127 on sole plane 118. The distance, as viewed in FIG. 2, from shaft plane 122 to sole point 150 represents a face progression 130. The design reference frame is defined with its origin at sole point 150, a Y axis 152 parallel to face center plane 110 and shaft plane 122, an X axis 154 parallel to sole plane 118 and shaft plane 122, and a Z axis 156 parallel to sole plane 118 and face center plane 110.

A center of gravity for golf club head 100 is determined from the distribution of the mass of head 100 and hosel 103 as well as the portion of shaft 102 in hosel 103 and two inches of shaft 102 extending above hosel 103. Thus, although reference is made to the center of gravity of the head herein, this center of gravity is to be understood as including the hosel and the portions of the shaft identified above.

Figure 4:
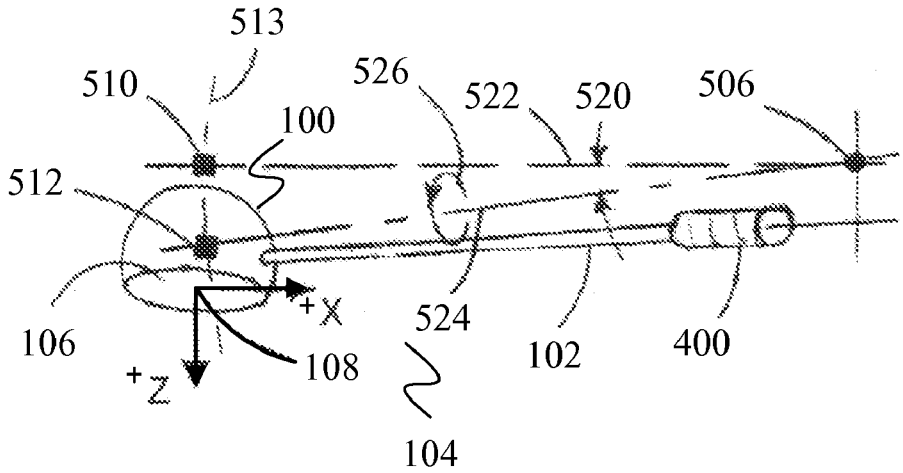
FIG. 4 is an expanded top view of a golf club under one embodiment.
Figure 5:
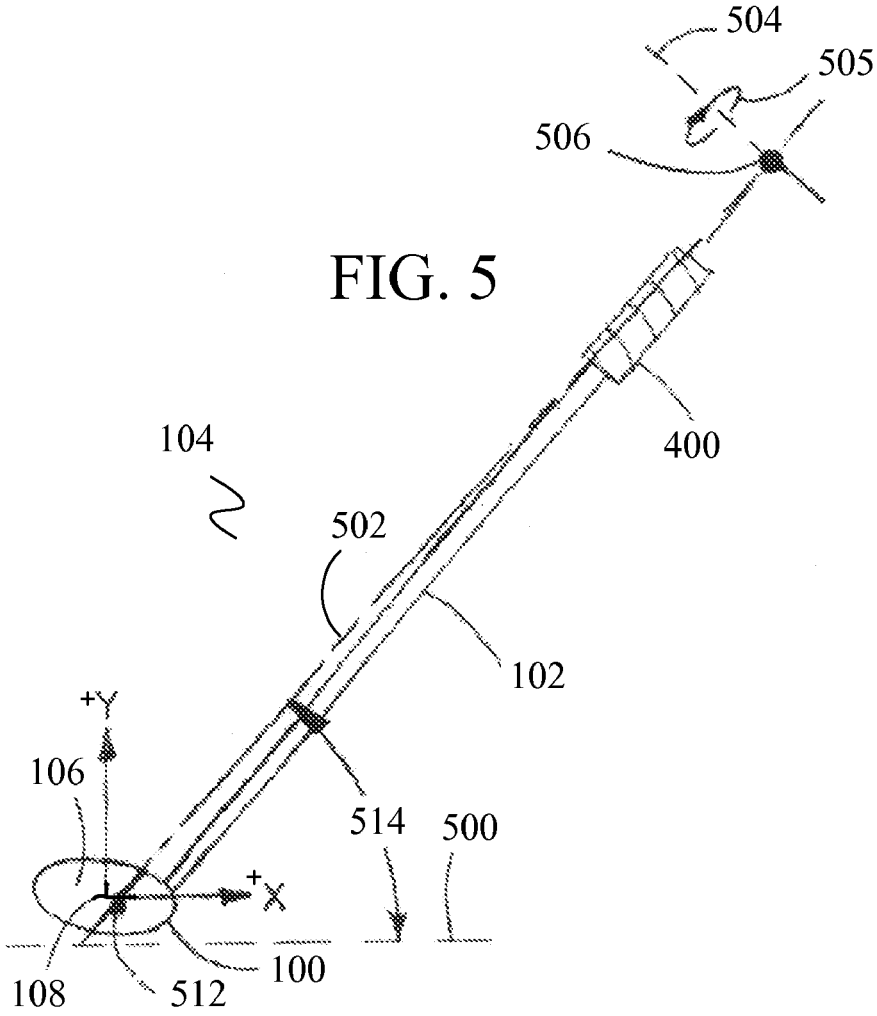
FIG. 5 is an expanded front view of the golf club of FIG. 4.

FIGS. 4 and 5 provide an expanded top view and an expanded front view of golf club 104. In FIGS. 4 and 5, shaft 102 is shown to include a handle or grip 400 on the end opposite golf club head 100. Golf club 104 is used to hit a golf ball (not shown) that either rests on a surface 500 or that rests on a tee extending upward from the surface 500. In the discussion below, surface 500 is assumed to be a horizontal plane on which the golfer swinging the club is standing and of the fairway. A golfer swings the center of gravity of the clubhead 100 of club 104 within a swing plane 502 about an axis of rotation 504 in a positive angular direction 505. Swing plane 502 is defined as a plane that includes three points 506, 510 and 512. Point 506 is an instantaneous center of rotation having zero linear velocity at the instant of impact, referred to as the pivot 506. Point 510 is the position of the center of gravity of golf club head 100 at the lowest point of the swing relative to plane 500. Point 512 is the position of the center of gravity of golf club head 100 at the point of impact with a golf ball. Within swing plane 502, the center of gravity moves along a swing arc 513. The axis of rotation 504 is perpendicular to the swing plane.

A swing plane angle 514 is defined between swing plane 502 and surface 500. A contact angle 520 is formed between a line 522 from center of gravity position 510 to pivot 506 and a line 524 from center of gravity position 512 to pivot 506. The contact angle represents the amount of rotation of the center of gravity of the golf club from the lowest point in the swing to the point of contact with the golf ball.

An orthogonal coordinate system is defined at impact based on swing plane 502 and surface 500. In particular, a Y axis of the coordinate system is defined as a normal to surface 500, a Z axis is defined as a normal to a plane orthogonal to surface 500 and containing center of gravity position 510 at the bottom of the swing and swing axis 504, and an X axis is defined as being orthogonal to the Y axis and Z axis and parallel to surface 500. As shown in FIGS. 4 and 5, the origin of this orthogonal coordinate system is defined at hit center 108 such that space above the origin is in the positive Y direction, space below the origin is in the negative Y direction, space behind the origin is in the negative Z direction, space in front of the origin is in the positive Z direction, space to the left of the origin when viewing from a negative Z position to a positive Z position is in the positive X direction and space to the right of the origin when viewing from a negative Z position to a positive Z position is in the negative X direction. This coordinate system is referred to herein as an impact reference frame, and is the same for left-handed and right-handed golfers. As discussed below, in other embodiments, the origin of the impact reference frame may alternately be defined at the center of gravity of the golf club head. Independent of the location of the origin of the impact reference frame, the orientations and positive directions of the axes of the impact reference frame are as defined above.

A rotation 526 of club head 100 about line 524 is called the wrist angle. It is created as the golfer chooses when gripping the golf club 104. The wrist angle is defined relative to a zero wrist angle. Zero wrist angle is set by first aligning the axes of the design reference frame with the axes of the impact reference frame. The club is then rotated about the Z axis of the impact reference frame to place the center of gravity and the pivot point 506 in swing plane 502. This orientation of the club defines a wrist angle of zero. An increased wrist angle is an angle formed by rotating the club along line 524 in the direction shown by arrow 526 so that the club face is more closed or less open and a decreased wrist angle is formed by rotating the club along line 524 in a direction opposite of arrow 526 so that the club face is more open or less closed.

Figure 6:
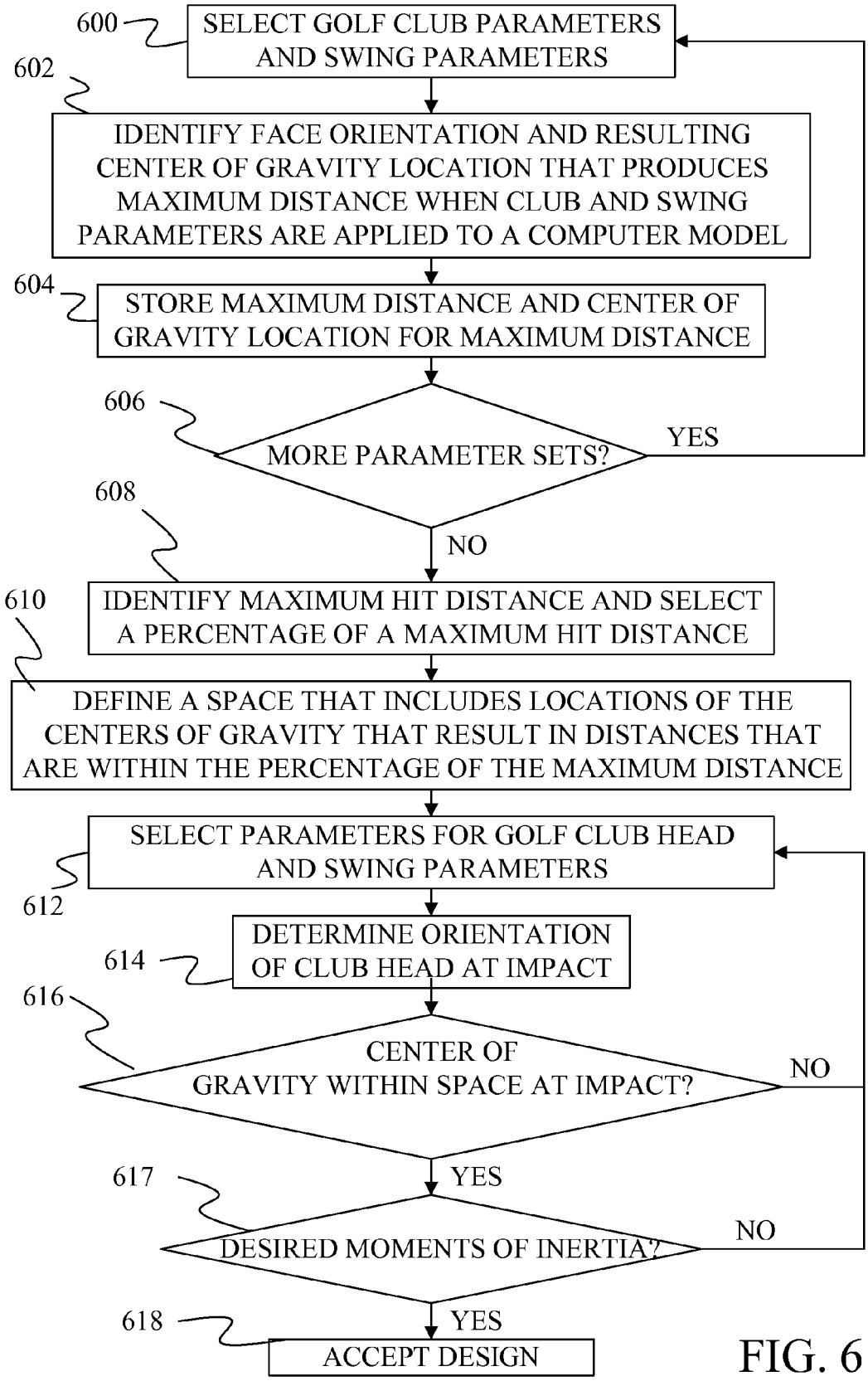
FIG. 6 is a flow diagram of a method of designing golf club heads by defining spaces in an impact reference frame under one embodiment.

Under embodiments described herein, a claimed position for a center of gravity relative to the hit center is determined by defining a space within the impact reference frame where the center of gravity should be located to hit the ball a distance that is within a selected percentage of a maximum distance. FIG. 6 provides a flow diagram of one method for defining such a space and for using such a space to select parameter values for a golf club.

In step 600 of FIG. 6, a set of golf club parameter values and swing parameter values is selected. Under one embodiment, a separate set of golf club parameter values and swing parameter values are formed for each combination of parameter values that can be formed from the following individual parameter values:

- Head Speed: 10 Handicap golfer head speed; 27.5 Handicap golfer head speed
- Head Weight: 190 gm; 200 gm; 210 gm
- Discretionary Weight/Head Weight ratio: 0.30; 0.50; 0.70
- Discretionary Weight Distribution: 255 possible distributions
- Swing Plane Angle: 46 degrees; 55 degrees
- Contact Angle: 1.7 degrees; 3.4 degrees
- Shaft Linear Density: 1.48 grams per inch
- Shaft Bending Stiffness Parameter (E*I): 7600 lb-in$^2$
- Shaft Length: 46 inches Under one embodiment, the head speed for the 10 handicap golfer is 100.7 miles per hour using a reference driver and the head speed for the 27.5 handicap golfer is 73.8 miles per hour. The reference driver has a 88 gram shaft, 43 inch club length, 200 gram head, and a 43.5 gram grip. The discretionary weight-to-head weight ratio is based on a separation of the head weight into an essential weight and a discretionary weight. The essential weight is the weight of the structural elements including the club face, sole, crown, skirt, rear plate, hosel and the portion of the shaft in the club head hosel plus two inches of shaft above the hosel that are necessary to provide adequate structural strength to the head. The portions of the shaft included in the essential weight represent a reasonable allowance for the part of the shaft that effectively participates as part of the rigid mass impacting the ball. The remaining portion of the head weight is the discretionary weight.

Under one embodiment, this discretionary weight may be distributed among eight points inside the golf club head. Four of the eight points are located near the face and four near the rear plate. Of each set of four points, two are located at mid-height, one being near the head center and one near the heel, and two near the sole, again one being near the head center and the other near the heel. The discretionary weight may be placed as a single weight at any one of the eight points or may be divided into a number of equally weighted portions that are then positioned at separate points in the club head. For example, the discretionary weight may be divided into two portions, with one portion being positioned at one of the eight points and the other portion positioned at another of the eight points. Alternatively, the discretionary weight may be divided into five equal portions with each portion being positioned at a separate point in the club head. The possible divisions of the discretionary weight and the possible positions for those divisions results in 255 possible discretionary weight distributions.

Under some embodiments, the discretionary weights are formed of high density material while the skirt and crown of the head are formed from strong low density materials. Using such materials makes it easier to change the position of the center of gravity and the moments of inertia of the head using the possible discretionary weight distributions.

The center of gravity of the club head is determined using the weights and positions of the structural elements that form the essential weight of the club head as well as the discretionary weight distribution using techniques that are well known in the art.

Although a limited set of possible parameter values is listed above, different parameter values may be used. For example, any swing plane angle between 40 and 60 degrees, considered to be representative of a normal golf swing, may be used. In addition, other parameters may be included.

At step 602, a face orientation and resulting center of gravity location in the impact frame are determined that maximize the distance the ball travels when the selected set of club and swing parameter values are applied to a computer model. This determination can be made by applying the selected set of club and swing parameter values to the model using a plurality of different face orientations and selecting the orientation that maximizes the distance the ball travels. The face orientation of the club is defined by the angle between the orthogonal projection of the normal to the face at the hit center on the X-Z plane (Y=0 plane) and the +Z axis, and the angle this normal makes with its orthogonal projection on the Y=0 plane. Under one embodiment, this model computes the flight distance (carry) of the ball by numerical integration of the differential equations of motion with variable lift and drag coefficients. Under one embodiment, air properties are defined for air at 29.92 inches of mercury, 70 degrees Fahrenheit, and 20% relative humidity.

The model also calculates an approximation of the distance the ball will bounce and roll after landing. Even though bounce and roll distance is rather indefinite, it is a significant factor in distance and should not be completely ignored. The equation for bounce and roll (ZBR) as measured on a typical, level fairway is:

$$ZBR=(0.868*V+0.00173*V^2)*\cos(k+24.4+0.00112*N)[\text{yards}] \quad \text{EQ. 1}$$

where V is the ball velocity [mph] at impact with the ground, k is the acute angle of ball's velocity vector at impact with the ground [deg], and N is the backspin rate (always positive) [rpm]. The ball bounces and rolls in the direction of the orthogonal projection of the ball's velocity vector onto the ground surface as it first impacts the ground.

The aerodynamic behavior of the golf ball used under one embodiment is defined by the lift and drag coefficients and the spin decay model for the balata ball as described in "Second Report on Study of Spin Generation", United States Golf Association, USGA, and The Royal and Ancient Golf Club of St Andrews, R&A, Jan. 11, 2007, Appendix C. The elastic property of the clubhead-ball-impact at the hit center under one embodiment is defined by a characteristic time of 240 micro-seconds as discussed in "Procedure for Measuring the Flexibility of a Golf Clubhead", USGA, Revision 1.0, Dec. 1, 2003 and "Technical Description of the Pendulum Test, Revised Version, Discussion of points raised during Notice & Comment Period", USGA and R&A, November 2003, page 11. Each of these references is hereby incorporated by reference.

Once the face orientation that maximizes distance has been determined, the location of the center of gravity relative to the hit center within the impact reference frame for that face orientation is recorded along with the maximum distance for the set of club and swing parameter values at step 604. Thus, the center of gravity location is recorded for the face orientation that maximizes distance for the set of club and swing parameter values.

At step 606, the method determines if there are more sets of club and swing parameter values to be considered. If there is another set, the next set is selected at step 600 and steps 602 and 604 are repeated for the new club and swing parameter values.

At step 608, for each head speed value, a maximum hit distance is determined from the distances recorded in step 604. In addition, a percentage of these maximum distances is selected. Example percentages include distances that are within 0.5%, 1.0%, and 1.5% of these maximum distances.

Once the percentage of the maximum distance has been selected, within each group of designs with the same head speed, the locations of centers of gravity associated with shot distances that fall within the percentage of the maximum distance for that group are identified and a space that contains the center of gravity locations so identified from all these groups is defined in the impact reference frame at step 610. In this context, "space" includes definition of its shape, size, location, and orientation. In defining this space, a balance is drawn between providing a space description that has a relatively simple mathematical expression in the impact reference frame and a space that is no larger than necessary to contain the locations of the centers of gravity. Under one embodiment, the space is defined as a partial ellipsoid as shown in more detail below.

Note that the space for the locations of the centers of gravity is defined within the impact reference frame based on locations of centers of gravity that are associated with different face orientations, different club parameter values, and different swing parameter values. Because of this, the space in the impact reference frame cannot be transformed into a single space in the design reference frame that can be used with all face orientations, club parameter values and swing parameter values. Thus, in this discussion the novel space is defined in the impact frame but not in the design frame.

After the space for the location of the center of gravity has been defined in the impact frame, possible designs for the golf club may be evaluated. At step 612, a set of parameter values for a golf club design and a set of swing parameters are selected. The golf club parameter values and the set of swing parameter values are used to determine the orientation of the head at impact for maximum distance at step 614. This can be done using finite element analysis where the distance the ball will travel is computed by applying the golf club parameter values and the swing parameter values to a model that attempts to accurately model the flight, bounce and roll of the golf ball after impact to determine a ball stop point. Alternatively, a prototype of the golf club may be formed and a video capture system may be used during swinging of the club to determine the orientation of the club for maximum distance at impact. In such an alternative, an actual ball is struck by the prototype of the club and the distance from the impact point to the ball stop point is measured to determine which orientation produces the maximum distance. Using this orientation, a determination is made as to whether the center of gravity is located within the defined space in the impact reference frame. If the center of gravity is not within the space in the impact reference frame at step 616, a new set of parameter values for the golf club head is selected by returning to step 612 and steps 614 and 616 are repeated. When returning to step 612, a new set of swing parameters may also be selected or the same set of swing parameters may be used again.

When a club head design produces a center of gravity located within the defined space at step 616, the process continues at step 617, where the moments of inertia of the club head at impact are evaluated to see if they meet a desired set of moments of inertia. The moments of inertia are determined based on the weights and positions of the structural elements that form the essential weight of the club head as well as the distribution of the discretionary weights at impact, using techniques known in the art. In some embodiments, shot distance is improved upon by ensuring that the moments of inertia about axes that intersect at the center of gravity and are parallel to the X and Y axes of the impact reference frame are greater than 350 gm-in$^2$. If the moments of inertia are not as desired, the process returns to step 612. If the moments of inertia are as desired, the design may be accepted at step 618.

Using steps 600-610, the present inventors have defined a collection of spaces as described below with reference to equations 2-19. Under most embodiments, a designer can use the spaces defined in these equations without having to perform steps 600-610. In such circumstances, only steps 612-618 need to be performed to design a new golf club.

As noted above, the space defined in the impact frame for center of gravity locations is a partial ellipsoid. Under one embodiment, using a percentage of maximum distance of 1.5%, this partial ellipsoid is defined in the impact reference frame for a right-handed golf club as those points P satisfying:

$$\left(\left(\frac{0.836P_x - 0.501P_y + 0.224P_z - 0.492}{0.69}\right)^2 + \left(\frac{0.549P_x + 0.763P_y - 0.341P_z - 0.075}{0.45}\right)^2 + \left(\frac{0.408P_y + 0.913P_z + 3.166}{2.90}\right)^2\right) \leq 1 \quad \text{EQ. 2}$$

where $P_x$, $P_y$, and $P_z$ are the X, Y, and Z coordinates, respectively, in inches from the hit center origin in the impact reference frame and where $$0.408P_y + 0.913P_x + 3.166 \geqq 0 \quad \text{EQ. 3}$$

Figure 7:
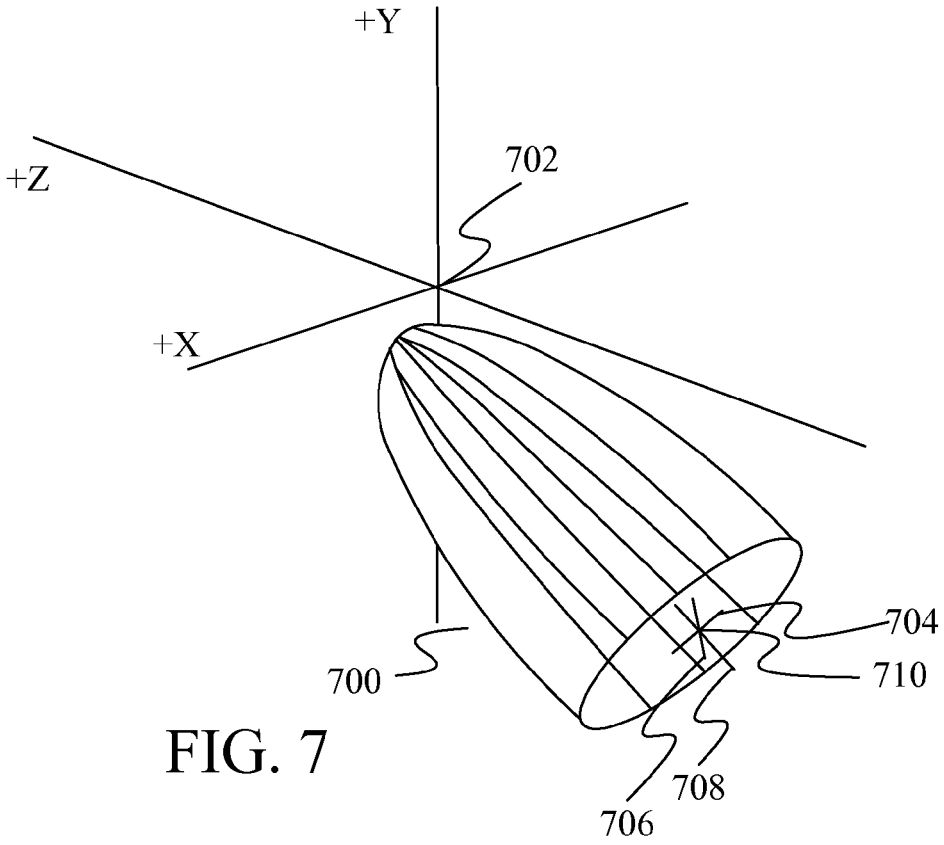
FIG. 7 is a perspective view of a partial ellipsoid space in the impact reference frame under one embodiment.
Figure 8:
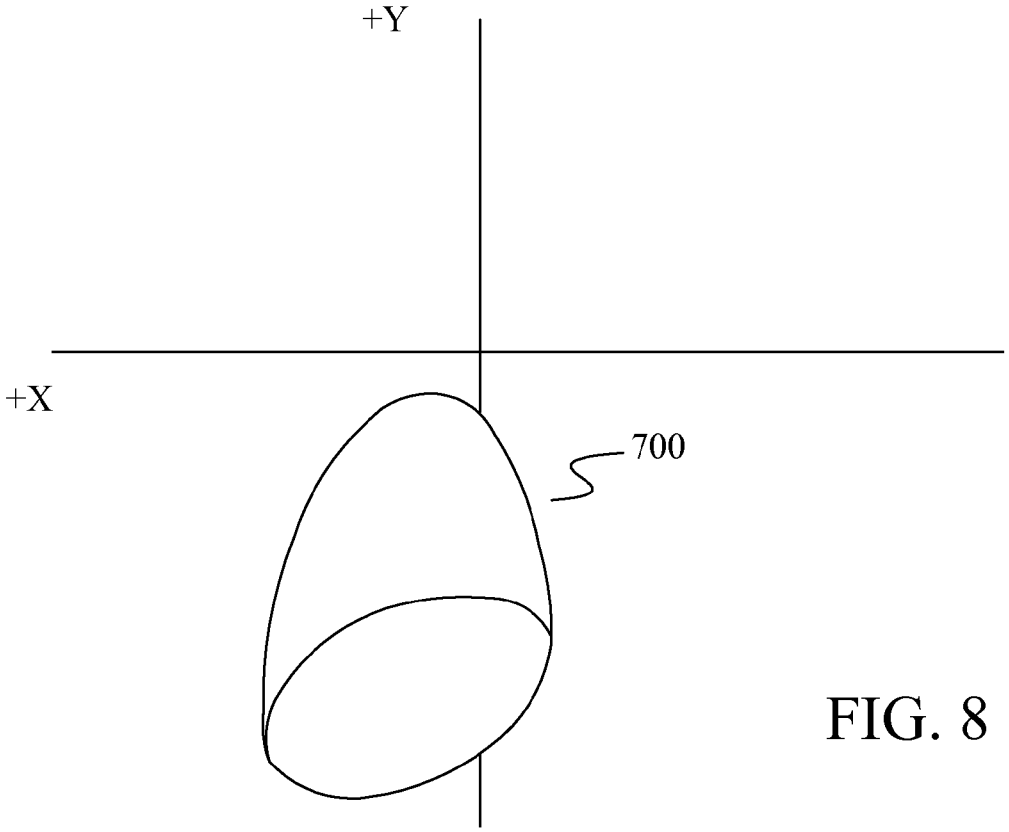
FIG. 8 shows an orthogonal projection of the partial ellipsoid of FIG. 7 on the Z=0 plane.
Figure 9:
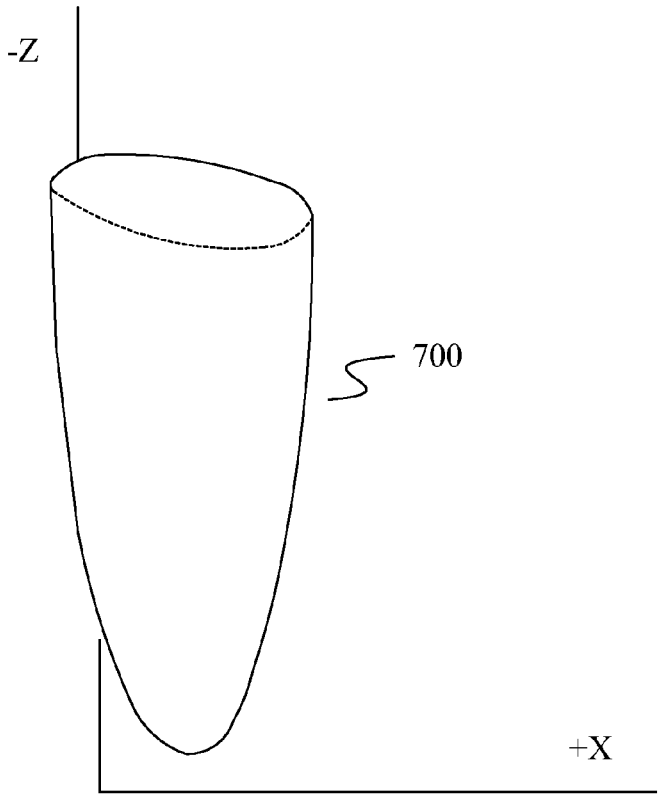
FIG. 9 shows an orthogonal projection of the partial ellipsoid of FIG. 7 on the Y=0 plane.
Figure 10:
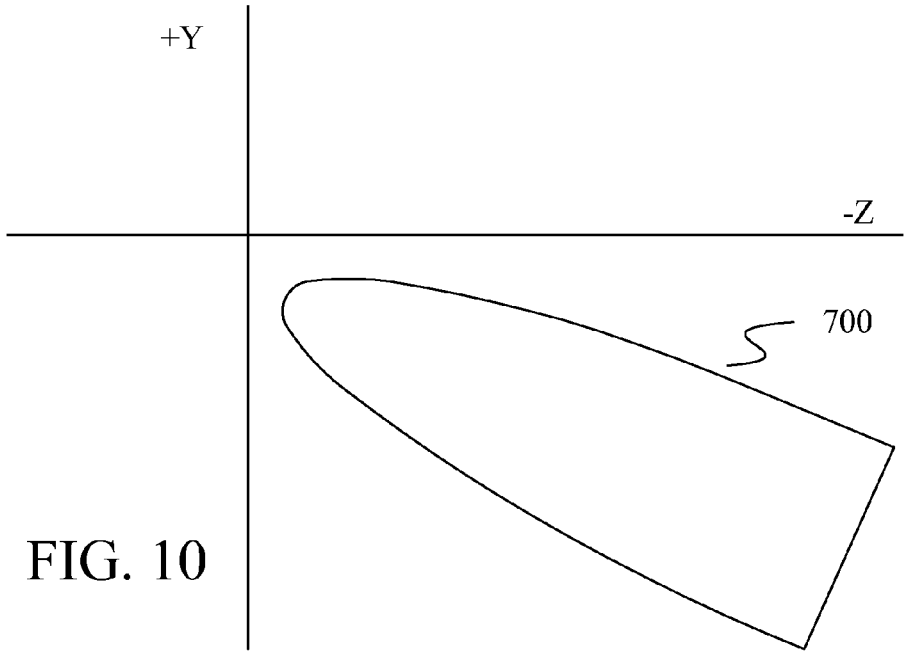
FIG. 10 shows an orthogonal projection of the partial ellipsoid of FIG. 7 on the X=0 plane.

FIG. 7 shows a perspective view of the impact reference frame with a space 700 defined by Equations 2 and 3 above. In FIG. 7, origin 702 is the hit center on the club head and the impact reference frame is defined as found above. As shown in FIGS. 8-10, the space for the center of gravity location is behind the face of the club (−Z direction), is below the hit center (−Y direction), and is generally toward the heel of the club (+X direction). When initially aligned with the respective X, Y, and Z axes of the impact frame, the major axes 704, 706 and 708 of the partial ellipsoid are rotated by a first rotation about the Z axis of the impact frame of −33.3 degrees followed by a second rotation of −24.1 degrees about the X axis of the impact reference frame, where positive rotations follow the right-hand rule for the impact frame coordinate system. In addition, the origin 710 of the major axes of the partial ellipsoid is the point in the impact frame with (X,Y,Z) coordinates of (0.40 inches, −1.45 inches, −2.82 inches).

FIG. 8 shows an orthogonal projection of space 700 on the Z=0 plane, FIG. 9 shows an orthogonal projection of space 700 on the Y=0 plane, and FIG. 10 shows an orthogonal projection of space 700 on the X=0 plane.

Under a second embodiment, using a percentage of maximum distance of 1.0%, the partial ellipsoid is defined in the impact reference frame for a right-handed golf club as those points P satisfying:

$$\left(\left(\frac{0.836P_x - 0.501P_y + 0.224P_z - 0.492}{0.64}\right)^2 + \left(\frac{0.549P_x + 0.763P_y - 0.341P_z - 0.075}{0.42}\right)^2 + \left(\frac{0.408P_y + 0.913P_z + 3.166}{2.55}\right)^2\right) \leq 1 \quad \text{EQ. 4}$$

and where $$0.408P_y + 0.913P_z + 3.166 \geqq 0 \quad \text{EQ. 5}$$

Figure 11:
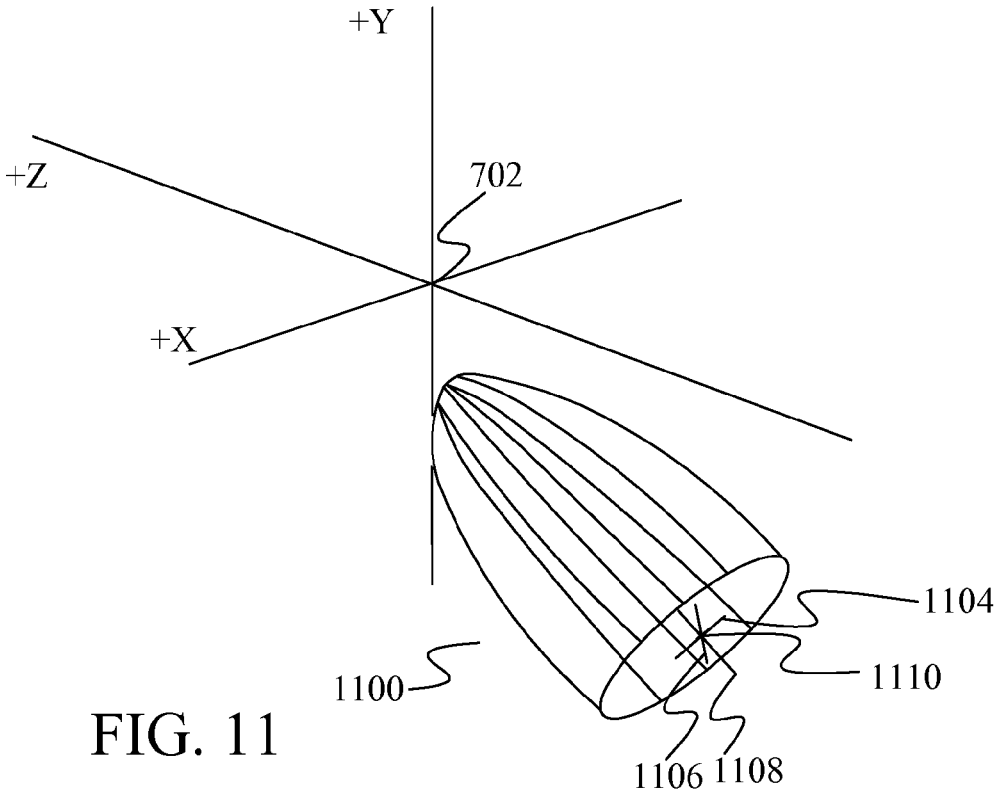
FIG. 11 is a perspective view of a partial ellipsoid space in the impact reference frame under a second embodiment.

FIG. 11 shows a perspective view of the impact reference frame with a space 1100 defined by Equations 4 and 5 above. The major axes 1104, 1106, and 1108 of the partial ellipsoid of space 1100 have been rotated in the same manner as the major axes of space 700 and the origin 1110 of the major axes has been translated in the same manner as the origin for space 700. The only difference between the two partial ellipsoids is that partial ellipsoid 1100 is smaller along each major axis. As a result, partial ellipsoid 1100 shares a major axes origin with partial ellipsoid 700 but would fit completely within partial ellipsoid 700.

Figure 12:
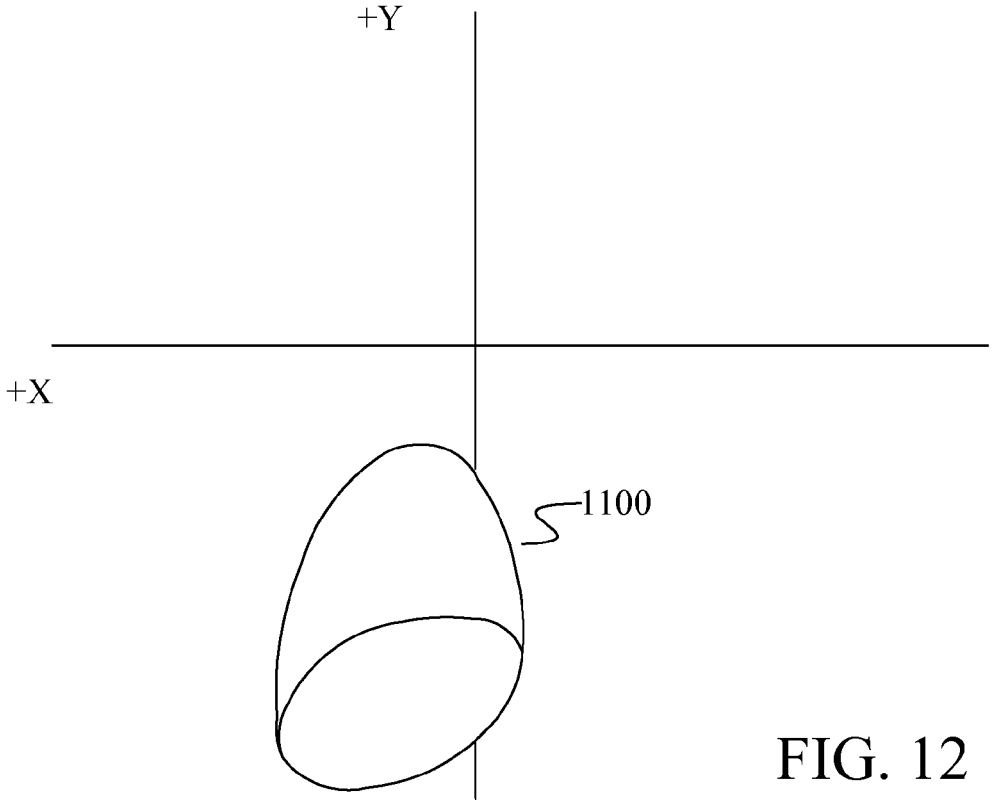
FIG. 12 shows an orthogonal projection of the partial ellipsoid of FIG. 11 on the Z=0 plane.
Figure 13:
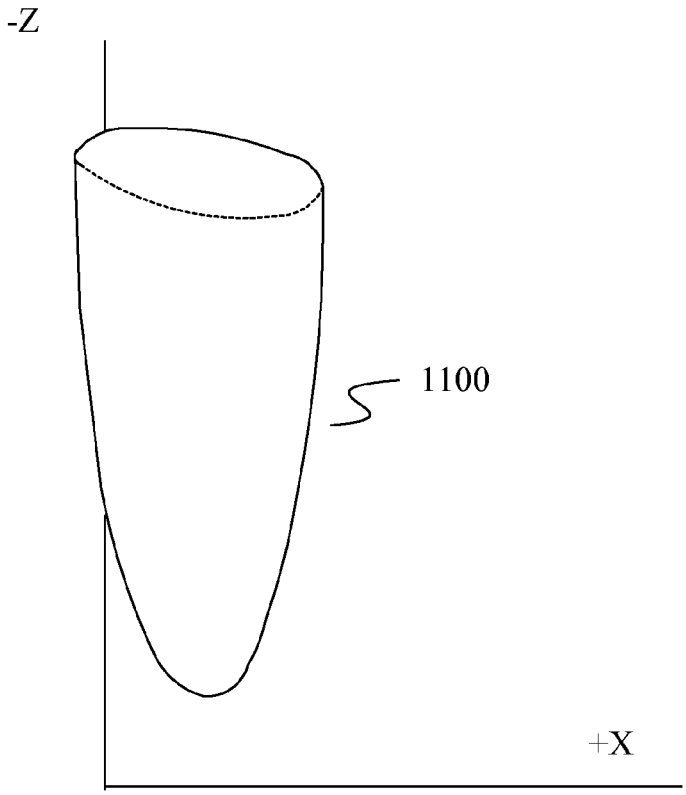
FIG. 13 shows an orthogonal projection of the partial ellipsoid of FIG. 11 on the Y=0 plane.
Figure 14:
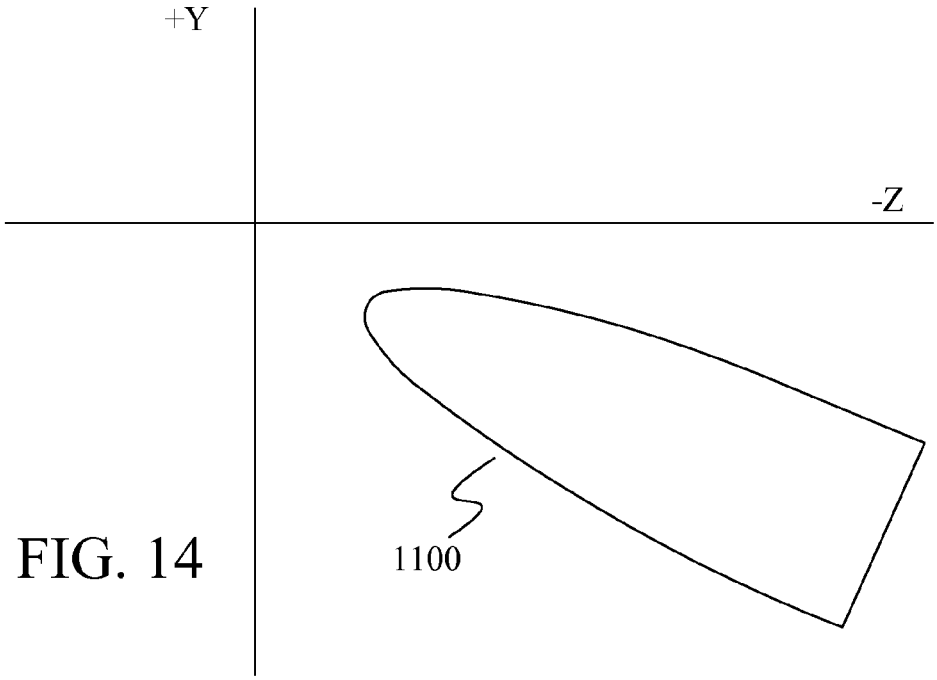
FIG. 14 shows an orthogonal projection of the partial ellipsoid of FIG. 11 on the X=0 plane.

FIG. 12 shows an orthogonal projection of space 1100 on the Z=0 plane, FIG. 13 shows an orthogonal projection of space 1100 on the Y=0 plane, and FIG. 14 shows an orthogonal projection of space 1100 on the X=0 plane.

Under a third embodiment, using a percentage of maximum distance of 0.5%, the partial ellipsoid is defined in the impact reference frame for a right-handed golf club as those points P satisfying:

$$\left(\left(\frac{0.836P_x - 0.501P_y + 0.224P_z - 0.492}{0.48}\right)^2 + \left(\frac{0.549P_x + 0.763P_y - 0.341P_z - 0.075}{0.35}\right)^2 + \left(\frac{0.408P_y + 0.913P_z + 3.166}{2.20}\right)^2\right) \leq 1 \quad \text{EQ. 6}$$

and where $$0.408P_y + 0.913P_z + 3.166 \geqq 0. \quad \text{EQ. 7}$$

Figure 15:
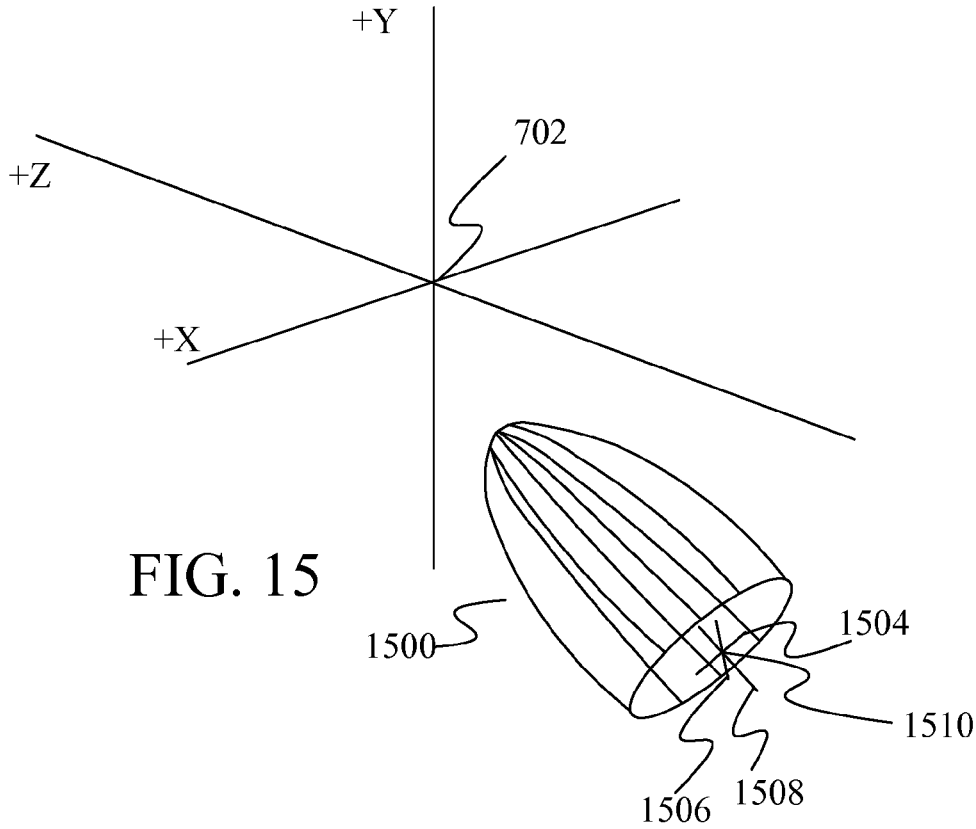
FIG. 15 is a perspective view of a partial ellipsoid space in the impact reference frame under a third embodiment.

FIG. 15 shows a perspective view of the impact reference frame with a space 1500 defined by Equations 6 and 7 above. The major axes 1504, 1506, and 1508 of the partial ellipsoid of space 1500 have been rotated in the same manner as the major axes of spaces 700 and 1100 and the origin 1510 of the major axes has been translated in the same manner as the major axes origins of spaces 700 and 1100. The only difference between partial ellipsoid 1500 and partial ellipsoid 1100 is that partial ellipsoid 1500 is smaller along each major axis. As a result, partial ellipsoid 1500 shares a major axes origin with partial ellipsoid 1100 but would fit completely within partial ellipsoid 1100 and thus completely within partial ellipsoid 700.

Figure 16:
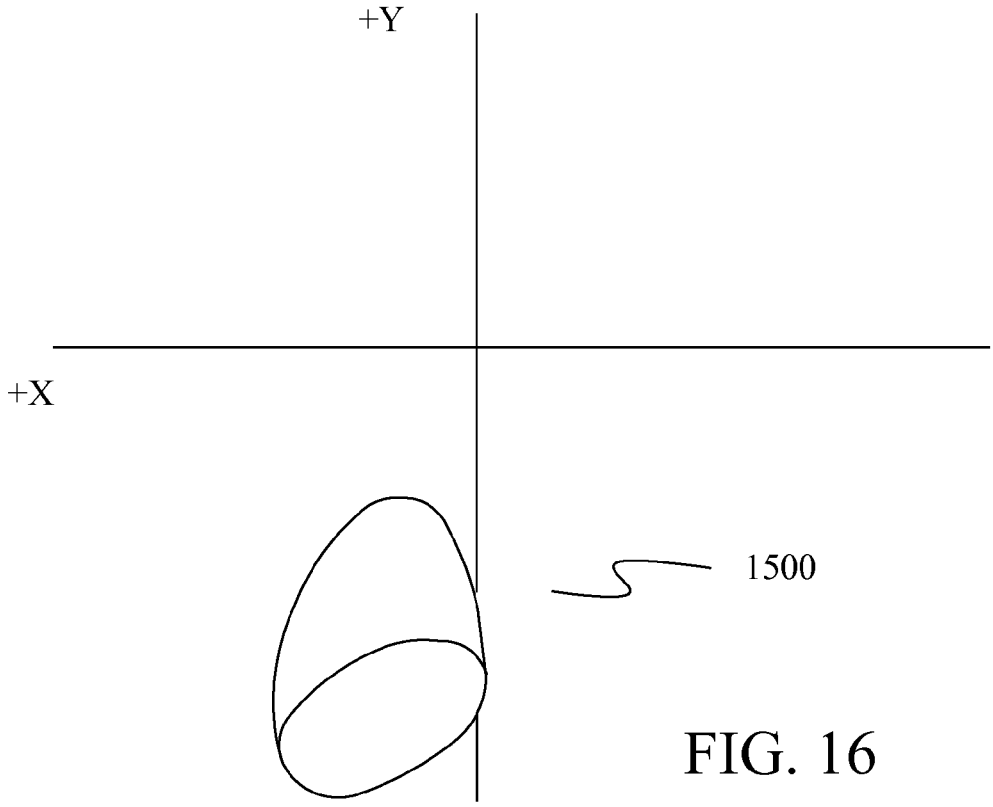
FIG. 16 shows an orthogonal projection of the partial ellipsoid of FIG. 15 on the Z=0 plane.
Figure 17:
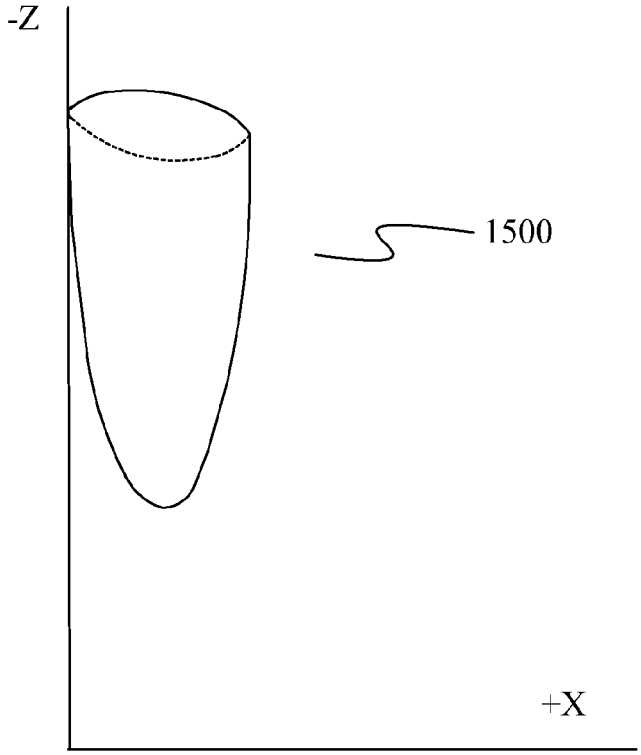
FIG. 17 shows an orthogonal projection of the partial ellipsoid of FIG. 15 on the Y=0 plane.
Figure 18:
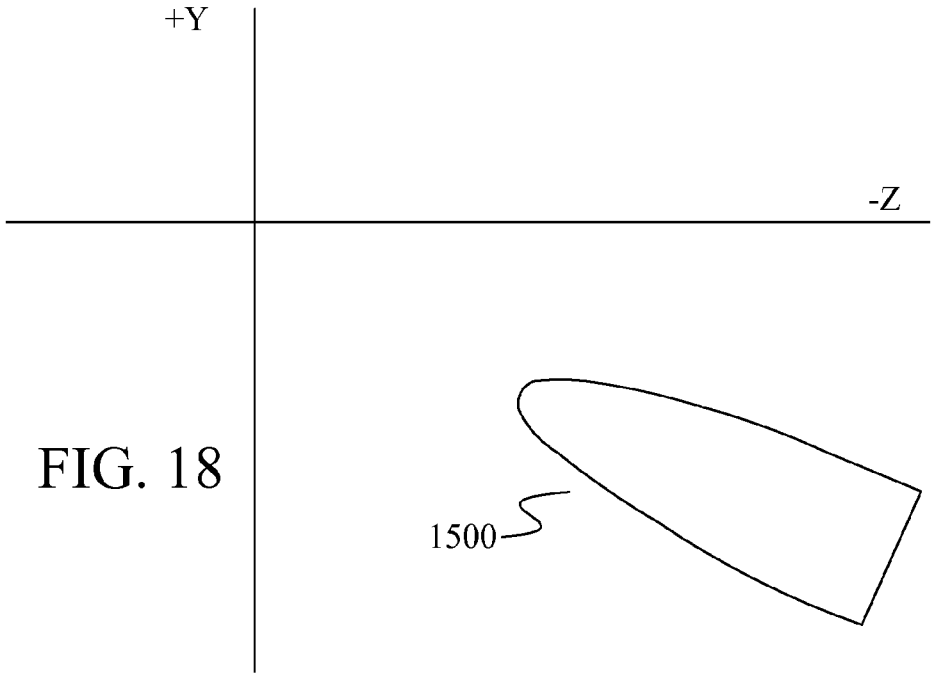
FIG. 18 shows an orthogonal projection of the partial ellipsoid of FIG. 15 on the X=0 plane.

FIG. 16 shows an orthogonal projection of space 1500 on the Z=0 plane, FIG. 17 shows an orthogonal projection of space 1500 on the Y=0 plane, and FIG. 18 shows an orthogonal projection of space 1500 on the X=0 plane.

For left-handed golf clubs, the partial ellipsoids discussed above are reflected in the X=0 plane of the impact reference frame. Using a percentage of maximum distance of 1.5%, the partial ellipsoid is defined in the impact reference frame for a left-handed golf club as those points P satisfying:

$$\left(\left(\frac{0.836P_x + 0.501P_y - 0.224P_z + 0.492}{0.69}\right)^2 + \left(\frac{-0.549P_x + 0.763P_y - 0.341P_z - 0.075}{0.45}\right)^2 + \left(\frac{0.408P_y + 0.913P_z + 3.166}{2.90}\right)^2\right) \leq 1 \quad \text{EQ. 8}$$

where $P_x$, $P_y$, and $P_z$ are the X, Y, and Z coordinates, respectively, in inches from the hit center origin in the impact reference frame and where $$0.408P_y + 0.913P_z + 3.166 \geqq 0 \quad \text{EQ. 9}$$

Using a percentage of maximum distance of 1.0%, the partial ellipsoid is defined in the impact reference frame for a left-handed golf club as those points P satisfying:

$$\left(\left(\frac{0.836P_x + 0.501P_y - 0.224P_z + 0.492}{0.64}\right)^2 + \left(\frac{-0.549P_x + 0.763P_y - 0.341P_z - 0.075}{0.42}\right)^2 + \left(\frac{0.408P_y + 0.913P_z + 3.166}{2.55}\right)^2\right) \leq 1 \quad \text{EQ. 10}$$

and where $$0.408P_y + 0.913P_z + 3.166 \geqq 0 \quad \text{EQ. 11}$$

Using a percentage of maximum distance of 0.5%, the partial ellipsoid is defined in the impact reference frame for a left-handed club as those points P satisfying:

$$\left(\left(\frac{0.836P_x + 0.501P_y - 0.224P_z + 0.492}{0.48}\right)^2 + \left(\frac{-0.549P_x + 0.763P_y - 0.341P_z - 0.075}{0.35}\right)^2 + \left(\frac{0.408P_y + 0.913P_z + 3.166}{2.20}\right)^2\right) \leq 1 \quad \text{EQ. 12}$$

and where $$0.408P_y+0.913P_z+3.166\geqq 0. \quad \text{EQ. 13}$$

Although embodiments discussed above have described defining a space for centers of gravity relative to a hit center, those skilled in the art will recognize that the converse could be described instead. In particular, using the methods of the present invention, a space for hit center locations can be defined relative to a center of gravity within the impact reference frame. To achieve this, the origin of the impact reference frame is shifted to the center of gravity while maintaining the orientation of the X, Y and Z axes.

Using the center of gravity as the origin results in small modifications to the method of FIG. 6. In particular, during steps 602 and 604 of FIG. 6, the location of the hit center relative to the center of gravity origin is stored instead of storing the center of gravity location. At step 610, a space is defined that includes locations of hit centers relative to the center of gravity origin. Club designs are then evaluated to see if the hit center falls within the defined space.

Under one embodiment for a right-handed golf club, a space defined for the hit center locations using a percentage of maximum distance of 1.5% is a space having points P satisfying:

$$\left(\left(\frac{0.836P_x-0.501P_y+0.224P_z+0.492}{0.69}\right)^2+\left(\frac{0.549P_x+0.763P_y-0.341P_z+0.075}{0.45}\right)^2+\left(\frac{0.408P_y+0.913P_z-3.166}{2.90}\right)^2\right)\leq 1 \quad \text{EQ. 14}$$

where $P_x$, $P_y$, and $P_z$ are the X, Y, and Z coordinates, respectively, in inches from the center of gravity origin and where $$0.408P_y+0.913P_z-3.166\leqq 0 \quad \text{EQ. 15}$$

Under a second embodiment for a right-handed golf club, a space defined for the hit center locations using a percentage of maximum distance of 1.0% is a space having points P satisfying:

$$\left(\left(\frac{0.836P_x-0.501P_y+0.224P_z+0.492}{0.64}\right)^2+\left(\frac{0.549P_x+0.763P_y-0.341P_z+0.075}{0.42}\right)^2+\left(\frac{0.408P_y+0.913P_z-3.166}{2.55}\right)^2\right)\leq 1 \quad \text{EQ. 16}$$

and where $$0.408P_y+0.913P_z-3.166\leqq 0 \quad \text{EQ. 17}$$

Under a third embodiment for a right-handed golf club, a space defined for the hit center locations using a percentage of maximum distance of 0.5% is a space having points P satisfying:

$$\left(\left(\frac{0.836P_x-0.501P_y+0.224P_z+0.492}{0.48}\right)^2+\left(\frac{0.549P_x+0.763P_y-0.341P_z+0.075}{0.35}\right)^2+\left(\frac{0.408P_y+0.913P_z-3.166}{2.20}\right)^2\right)\leq 1 \quad \text{EQ. 18}$$

and where $$0.408P_y+0.913P_z-3.166\leqq 0 \quad \text{EQ. 19}$$

The major axes of each of the partial ellipsoids of equations 14-19 share a common origin with (X,Y,Z) coordinates in the impact frame of (−0.40 inches, 1.45 inches, 2.82 inches). In addition, the orientations for the major axes of the partial ellipsoids of equations 14-19 are the same as each other. In addition, the partial ellipsoids of equations 16-19 fit within the partial ellipsoid of equations 14 and 15 and the partial ellipsoid of equations 18 and 19 fits within the partial ellipsoid of equations 16 and 17.

Note that the spaces of equations 14-19 are reflections of the spaces of equations 2-7 through the origin used to define the spaces of equations 2-7. Because of this, if any point in the space defined by equations 2 and 3 is selected as the center of gravity position and then equations 14 and 15 are used to define a space for a hit center based on that center of gravity, the original hit center used with equations 2 and 3 will be within the hit center space defined be equations 14 and 15.

In addition to the position of the center of gravity at impact, another design criterion is the ratio of the height of the club to the width of the club. Head designs are conventionally about twice as wide (toe-heel direction) as they are high (sole-crown direction). Because of this, it is easier to move the center of gravity of a head toward the heel in the toe-heel direction than down toward the sole in the sole-crown direction. However, simply shifting the center of gravity toward the heel will not necessarily place it in the appropriate space in the impact frame, because the center of gravity must also be moved downward relative to the hit center. Under one embodiment, this shift downward is achieved using a high lie angle for the club. When swinging a club with a high lie angle, the golfer rotates the club about the Z axis bringing the heel of the club down and the toe of the club up. If the center of gravity is positioned toward the heel of the club in the design frame, this rotation will assist in bringing the center of gravity into the space defined in the impact frame. Under many embodiments, a lie angle greater than 63 degrees has been used. The drop in the center of gravity can be augmented using a negative wrist angle to bring the back part of the heel further below the hit center.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A right-handed golf club comprising:

an upper shaft portion of a shaft;

a golf club head comprising:

a hosel accepting a part of the shaft;

a lower portion of the shaft comprising the part of the shaft in the hosel and two inches of shaft extending out from the hosel;

a center of gravity including the lower portion of the shaft; and a face having a hit center that is one of a set consisting of a hit center indicated by markings on the face as being a point preferred over all other points on the club for contacting the ball and a hit center that is the same as a face center of the face, the hit center defining an origin of an impact reference frame having X, Y and Z axes defined based on swinging the golf club about a swing axis along a swing plane that is angled to a surface, wherein the Y axis is defined as a normal to the surface, the Z axis is defined as a normal to a plane orthogonal to the surface and containing the center of gravity at a bottom of the swing and the swing axis, and the X axis is defined as being orthogonal to the Y axis and Z axis and parallel to the surface and wherein space above the origin is in a positive Y direction, space below the origin is in a negative Y direction, space behind the origin is in a negative Z direction, space in front of the origin is in a positive Z direction, space to the left of the origin when viewing from a negative Z position to a positive Z position is in a positive X direction and space to the right of the origin when viewing from a negative Z position to a positive Z position is in a negative X direction;

wherein the center of gravity is positioned relative to the hit center such that when the hit center impacts a ball during a swinging of the golf club along a swing plane angled between 40 and 60 degrees to the surface, with the face at the hit center oriented for maximum distance where distance is the sum of flight and bounce and roll distance as measured by the X and Z coordinates of the ball stop point in the impact reference frame, the center of gravity is positioned in a space defined as a partial ellipsoid described as those points P satisfying:

$$\left(\left(\frac{0.836P_x - 0.501P_y + 0.224P_z + 0.492\ \text{inches}}{0.69\ \text{inches}}\right)^2 + \left(\frac{0.549P_x + 0.763P_y - 0.341P_z - 0.075\ \text{inches}}{0.45\ \text{inches}}\right)^2 + \left(\frac{0.408P_y + 0.913P_z + 3.166\ \text{inches}}{2.90\ \text{inches}}\right)^2\right) \leq 1$$

where $P_X$, $P_y$, and $P_z$ are the X, Y, and Z coordinates, respectively, of a point P in inches from the hit center origin of the impact reference frame and where $0.408P_y+0.913P_z+3.166$ inches$\geqq 0$ inches.

2. The golf club of claim 1 wherein when a ball impacts the hit center with the face oriented for maximum distance the center of gravity is positioned in a space defined as a partial ellipsoid described as those points P satisfying:

$$\left(\left(\frac{0.836P_x - 0.501P_y + 0.224P_z - 0.492\ \text{inches}}{0.64\ \text{inches}}\right)^2 + \left(\frac{0.549P_x + 0.763P_y - 0.341P_z - 0.075\ \text{inches}}{0.42\ \text{inches}}\right)^2 + \left(\frac{0.408P_y + 0.913P_z + 3.166\ \text{inches}}{2.55\ \text{inches}}\right)^2\right) \leq 1$$

and where $0.408P_y+0.913P_z+3.166$ inches$\geqq 0$ inches.

3. The golf club of claim 2 wherein a lie angle between the centerline of the shaft and an orthogonal projection of a centerline of the shaft on a sole plane is greater than 63 degrees.

4. The golf club of claim 3 wherein the orientation of the club head face for maximum distance is achieved using a decreased wrist angle.

5. The golf club of claim 2 wherein the moments of inertia about the center of gravity along axes that intersect at the center of gravity and are parallel to the X and Y axes each exceed 350 gm·in$^2$ when the hit center impacts the ball.

6. The golf club of claim 1 wherein when a ball impacts the hit center with the face oriented for maximum distance, the center of gravity is positioned in a space defined as a partial ellipsoid described as those points P satisfying:

$$\left(\left(\frac{0.836P_x - 0.501P_y + 0.224P_z - 0.492\ \text{inches}}{0.48\ \text{inches}}\right)^2 + \left(\frac{0.549P_x + 0.763P_y - 0.341P_z - 0.075\ \text{inches}}{0.35\ \text{inches}}\right)^2 + \left(\frac{0.408P_y + 0.913P_z + 3.166\ \text{inches}}{2.20\ \text{inches}}\right)^2\right) \leq 1$$

and where $P_x$, $P_y$, and $P_x$ are the X, Y, and Z coordinates, respectively, of a point P in inches from the hit center origin of the impact reference frame and $0.408P_y+0.913P_z+3.166$ inches$\geqq 0$ inches.

7. The golf club of claim 1 wherein a lie angle between the centerline of the shaft and an orthogonal projection of a centerline of the shaft on a sole plane is greater than 63 degrees.

8. The golf club of claim 7 wherein the orientation of the club head face for maximum distance is achieved using a decreased wrist angle.

9. The golf club of claim 1 wherein the moments of inertia about the center of gravity along axes that intersect at the center of gravity and are parallel to the X and Y axes each exceed 350 gm·in$^2$ when the hit center impacts the ball.

10. A left-handed golf club comprising:

an upper shaft portion of a shaft;

a golf club head comprising:

a hosel accepting a part of the shaft;

a lower portion of the shaft comprising the part of the shaft in the hosel and two inches of shaft extending out of the hosel;

a center of gravity including the lower portion of the shaft; and a face having a hit center that is one of a set consisting of a hit center indicated by markings on the face as being a point preferred over all other points on the club for contacting the ball and a hit center that is the same as a face center of the face, the hit center defining an origin of an impact reference frame having X, Y and Z axes defined based on swinging the golf club about a swing axis along a swing plane that is angled to a surface, wherein the Y axis is defined as a normal to the surface, the Z axis is defined as a normal to a plane orthogonal to the surface and containing the center of gravity at a bottom of the swing and the swing axis, and the X axis is defined as being orthogonal to the Y axis and Z axis and parallel to the surface and wherein space above the origin is in a positive Y direction, space below the origin is in a negative Y direction, space behind the origin is in a negative Z direction, space in front of the origin is in a positive Z direction, space to the left of the origin when viewing from a negative Z position to a positive Z position is in a positive X direction and space to the right of the origin when viewing from a negative Z position to a positive Z position is in a negative X direction;

wherein the center of gravity is positioned relative to the hit center such that when the hit center impacts a ball during a swinging of the golf club along a swing plane angled between 40 and 60 degrees to the surface with the face oriented for maximum distance, where distance is the sum of flight and bounce and roll distance as measured by the X and Z coordinates of the ball stop point in the impact reference frame, the center of gravity is positioned in a space defined as a partial ellipsoid described as those points P satisfying:

$$\left(\left(\frac{0.836P_x + 0.501P_y - 0.224P_z + 0.492\text{ inches}}{0.69\text{ inches}}\right)^2 + \left(\frac{-0.549P_x + 0.763P_y - 0.341P_z - 0.075\text{ inches}}{0.45\text{ inches}}\right)^2 + \left(\frac{0.408P_y + 0.913P_z + 3.166\text{ inches}}{2.90\text{ inches}}\right)^2\right) \leq 1$$

where $P_x$, $P_y$, and $P_x$ are the X, Y, and Z coordinates, respectively, of a point P in inches from the hit center origin of the impact reference frame and where $0.408P_y+0.913P_z+3.166\text{ inches} \geqq 0\text{ inches}$.

11. The golf club of claim 10 wherein when a ball impacts the hit center with the face oriented for maximum distance the center of gravity is positioned in a space defined as a partial ellipsoid described as those points P satisfying:

$$\left(\left(\frac{0.836P_x + 0.501P_y - 0.224P_z + 0.492\text{ inches}}{0.64\text{ inches}}\right)^2 + \left(\frac{-0.549P_x + 0.763P_y - 0.341P_z - 0.075\text{ inches}}{0.42\text{ inches}}\right)^2 + \left(\frac{0.408P_y + 0.913P_z + 3.166\text{ inches}}{2.55\text{ inches}}\right)^2\right) \leq 1$$

and where $0.408P_y+0.913P_z+3.166\text{ inches} \geqq 0\text{ inches}$.

12. The golf club of claim 10 wherein when a ball impacts the hit center with the face oriented for maximum distance, the center of gravity is positioned in a space defined as a partial ellipsoid described as those points P satisfying:

$$\left(\left(\frac{0.836P_x + 0.501P_y - 0.224P_z + 0.492\text{ inches}}{0.48\text{ inches}}\right)^2 + \left(\frac{-0.549P_x + 0.763P_y - 0.341P_z - 0.075\text{ inches}}{0.35\text{ inches}}\right)^2 + \left(\frac{0.408P_y + 0.913P_z + 3.166\text{ inches}}{2.20\text{ inches}}\right)^2\right) \leq 1$$

and where $0.408P_y+0.913P_z+3.166\text{ inches} \geqq 0\text{ inches}$.

13. The golf club of claim 12 wherein a lie angle between the centerline of the shaft and an orthogonal projection of a centerline of the shaft on a sole plane is greater than 63 degrees.

14. The golf club of claim 13 wherein the orientation of the club head face for maximum distance is achieved using a decreased wrist angle.

15. The golf club of claim 12 wherein the moments of inertia about the center of gravity along axes that intersect at the center of gravity and are parallel to the X and Y axes each exceed 350 $gm \cdot in^2$ when the hit center impacts the ball.

16. The golf club of claim 10 wherein a lie angle between the centerline of the shaft and an orthogonal projection of a centerline of the shaft on a sole plane is greater than 63 degrees.

17. The golf club of claim 16 wherein the orientation of the club head face for maximum distance is achieved using a decreased wrist angle.

18. The golf club of claim 10 wherein the moments of inertia about the center of gravity along axes that intersect at the center of gravity and are parallel to the X and Y axes each exceed 350 $gm \cdot in^2$ when the hit center impacts the ball.

* * * * *

UNITED STATES PATENT AND TRADEMARK OFFICE

CERTIFICATE OF CORRECTION

PATENT NO. : 7,955,190 B2
APPLICATION NO. : 12/630419
DATED : June 7, 2011
INVENTOR(S) : Frank D. Werner et al.

It is certified that error appears in the above-identified patent and that said Letters Patent is hereby corrected as shown below:

Column 8, line 63, replace Eq. 3 "$0.408P_y + 0.913P_x + 3.166 \geq 0$" with --$0.408P_y + 0.913P_z + 3.166 \geq 0$--.

Signed and Sealed this
Twenty-fourth Day of July, 2012

David J. Kappos

David J. Kappos
*Director of the United States Patent and Trademark Office*